US011142723B2

(12) United States Patent
Fernandez Prieto et al.

(10) Patent No.: US 11,142,723 B2
(45) **Date of Patent: *Oct. 12, 2021**

(54) FABRIC SOFTENER COMPOSITION COMPRISING ENCAPSULATED BENEFIT AGENT

(71) Applicant: The Procter & Gamble Company, Cincinnati, OH (US)

(72) Inventors: Susana Fernandez Prieto, Brussels (BE); Johan Smets, Lubbeek (BE); Pieter Jan Maria Saveyn, Heusden (BE); Laura Orlandini, Le Mont sur Lausanne (CH)

(73) Assignee: The Procter & Gamble Company, Cincinnati, OH (US)

( * ) Notice: Subject to any disclaimer, the term of this patent is extended or adjusted under 35 U.S.C. 154(b) by 71 days.

This patent is subject to a terminal disclaimer.

(21) Appl. No.: 15/920,478

(22) Filed: Mar. 14, 2018

(65) Prior Publication Data

US 2018/0265811 A1 Sep. 20, 2018

(30) Foreign Application Priority Data

Mar. 16, 2017 (EP) ..... 17161464

(51) Int. Cl.
*C11D 3/00* (2006.01)
*C11D 3/22* (2006.01)
(Continued)

(52) U.S. Cl.
CPC ..... *C11D 3/222* (2013.01); *C11D 1/62* (2013.01); *C11D 3/0015* (2013.01);
(Continued)

(58) Field of Classification Search
CPC ..... C11D 3/222; C11D 3/0015
See application file for complete search history.

(56) References Cited

U.S. PATENT DOCUMENTS 4,137,180 A 1/1979 Naik et al.
6,967,027 B1 * 11/2005 Heux ..... C08J 3/03 424/484

(Continued)

FOREIGN PATENT DOCUMENTS

EP 2824169 A1 1/2015
EP 2496676 B1 6/2016

(Continued)

OTHER PUBLICATIONS

Dearden, John C., et al.; The Measurement of Partition Coefficients; School of Pharmacy, Liverpool Polytechnic, Byrom Street, Liverpool L3 3AF, England; Quant. Struct.-Act. Relat.; vol. 7; Issue 3; 1988; pp. 133-144.

(Continued)

*Primary Examiner* — Necholus Ogden, Jr.
(74) *Attorney, Agent, or Firm* — Gregory S. Darley-Emerson

(57) ABSTRACT

The present invention relates to liquid fabric softener compositions comprising a quaternary ammonium ester softening active, cellulose fibers, and benefit agent capsules comprising a core and a shell encapsulating said core, wherein said shell comprises polyacrylate polymer, as well as methods of treating fabric and using same. Such liquid fabric softener compositions provide similar deposition of different types of fabric material.

10 Claims, 3 Drawing Sheets

(51) Int. Cl.

| | |
|---|---|
| ***C11D 3/50*** | (2006.01) |
| ***C11D 1/62*** | (2006.01) |
| ***C11D 17/00*** | (2006.01) |
| ***C11D 3/37*** | (2006.01) |
| ***C11D 11/00*** | (2006.01) |

(52) U.S. Cl.
CPC ..... *C11D 3/3757* (2013.01); *C11D 3/3773* (2013.01); *C11D 3/505* (2013.01); *C11D 11/0017* (2013.01); *C11D 17/0039* (2013.01)

(56) References Cited

U.S. PATENT DOCUMENTS

| | | | | |
|---|---|---|---|---|
| 2007/0275866 | A1 | 11/2007 | Dykstra | |
| 2013/0109612 | A1 | 5/2013 | Corona, III et al. | |
| 2014/0338134 | A1* | 11/2014 | Fernandez Prieto | C11D 17/0039 8/137 |
| 2015/0159119 | A1* | 6/2015 | Fernandez-Prieto | C11D 3/0015 510/527 |
| 2017/0211017 | A1* | 7/2017 | Sivik | C11D 3/30 |
| 2018/0105772 | A1* | 4/2018 | Gori | C11D 11/0017 |

FOREIGN PATENT DOCUMENTS

| | | | |
|---|---|---|---|
| WO | WO03062361 | A1 | 7/2003 |
| WO | WO2007062833 | A1 | 6/2007 |
| WO | WO2008057985 | A1 | 5/2008 |
| WO | WO2008076753 | A1 | 6/2008 |
| WO | WO2008079693 | A1 | 7/2008 |
| WO | WO2009037060 | A1 | 3/2009 |
| WO | WO2011054389 | A1 | 5/2011 |
| WO | WO2015006635 | A1 | 1/2015 |

OTHER PUBLICATIONS

Extended European Search Report; Application No. 17161464.7-1375; dated Jul. 9, 2017; 8 pages.

International Search Report and Written Opinion; Application Ser. No. PCT/US2018/022792; dated Jun. 19, 2018; 13 pages.

* cited by examiner

Figure 3: Apparatus B
Figure 3 Apparatus B Example Circulation Loop System
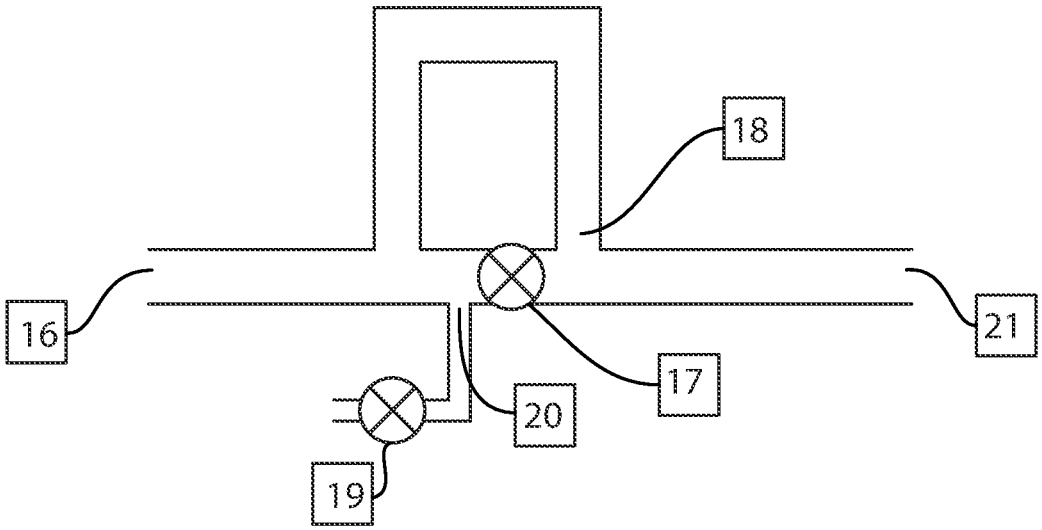

FABRIC SOFTENER COMPOSITION COMPRISING ENCAPSULATED BENEFIT AGENT

FIELD OF THE INVENTION

The invention is directed to liquid fabric softener compositions comprising encapsulated benefit agent and deposition aid.

BACKGROUND OF THE INVENTION

Liquid fabric softener compositions provide benefits to treated fabrics, particularly in the rinse phase of the laundry process, after the addition of the detergent composition. Such benefits include providing a pleasant smell to treated fabrics, thanks to the incorporation of perfumes into the fabric softener compositions. Because such benefit agents are often expensive components, encapsulation is used in order to improve the delivery of the benefit agent during use. A problem in the field is still that much of the encapsulated benefit agents are either not deposited or rinsed away before use. To reduce this problem deposition aids are used to improve the deposition of such encapsulated benefit agents. WO2007062833A1 describes cotton-substantive deposition aids, such as polysaccharides, preferably locust bean gum. WO2009937060A1 describes polyester-substantive deposition aids, preferably those containing dicarboxylic aromatic acid/polyol polymer, particularly a phthalate containing polymer.

Consumers desire that the benefit agents are released during use of treated fabrics. However, deposition aids which are selective for a specific type of fabric material only provide improved deposition and release of the encapsulated benefit agent for a specific type of fabric material while deposition and release of the encapsulated benefit agent is less with other types of fabric material. Consequently, to experience the improved benefit for different types of fabric material, the consumer is restricted by the choice of fabrics. Alternatively, the consumer needs to treat different types of fabric material with different fabric compositions which further complicates the laundry process.

Therefore, a need remains for liquid fabric softener compositions comprising encapsulated benefit agent and deposition aid which provides similar release of encapsulated benefit agent on a range of different types of fabric material.

EP2496676 (B1) describes the use of micro-fibrous cellulose to increase the deposition of perfume particles, preferably aminoplast core-shell particles, on fabrics. It discloses examples of deposition on cotton of perfume capsules uncoated and coated with vinyl acetate. WO2008/076753 (A1) relates to surfactant systems comprising microfibrous cellulose to suspend particulates. WO2008/079693 (A1) relates to a cationic surfactant composition comprising microfibrous cellulose to suspend particulates. WO2015/006635 relates to structured fabric care compositions comprising a fabric softener active and microfibrillated cellulose. WO03/062361 (A1) discloses liquid fabric conditioners comprising cellulose fibers and esterquats. WO2008057985 (A1) relates to surfactant thickened systems comprising microfibrous cellulose and methods of making same.

SUMMARY OF THE INVENTION

The present invention relates to liquid fabric softener compositions comprising quaternary ammonium ester fabric softening active, cellulose fibers, and benefit agent capsules comprising a core and a shell encapsulating said core, wherein said shell comprises a polyacrylate polymer. The present invention further relates to the use of such liquid fabric softener compositions and a method to treat fabrics, preferably polyester fabrics. The compositions of the present invention provide similar release of encapsulated benefit agent across different fabric types.

BRIEF DESCRIPTION OF THE DRAWINGS

While the specification concludes with claims particularly pointing out and distinctly claiming the invention, it is believed that the invention will be better understood from the following description of the accompanying figures in which like reference numerals identify like elements, and wherein:

FIG. 3 details the Apparatus B (see Methods).

DETAILED DESCRIPTION OF THE INVENTION

Definitions

Figure 1:
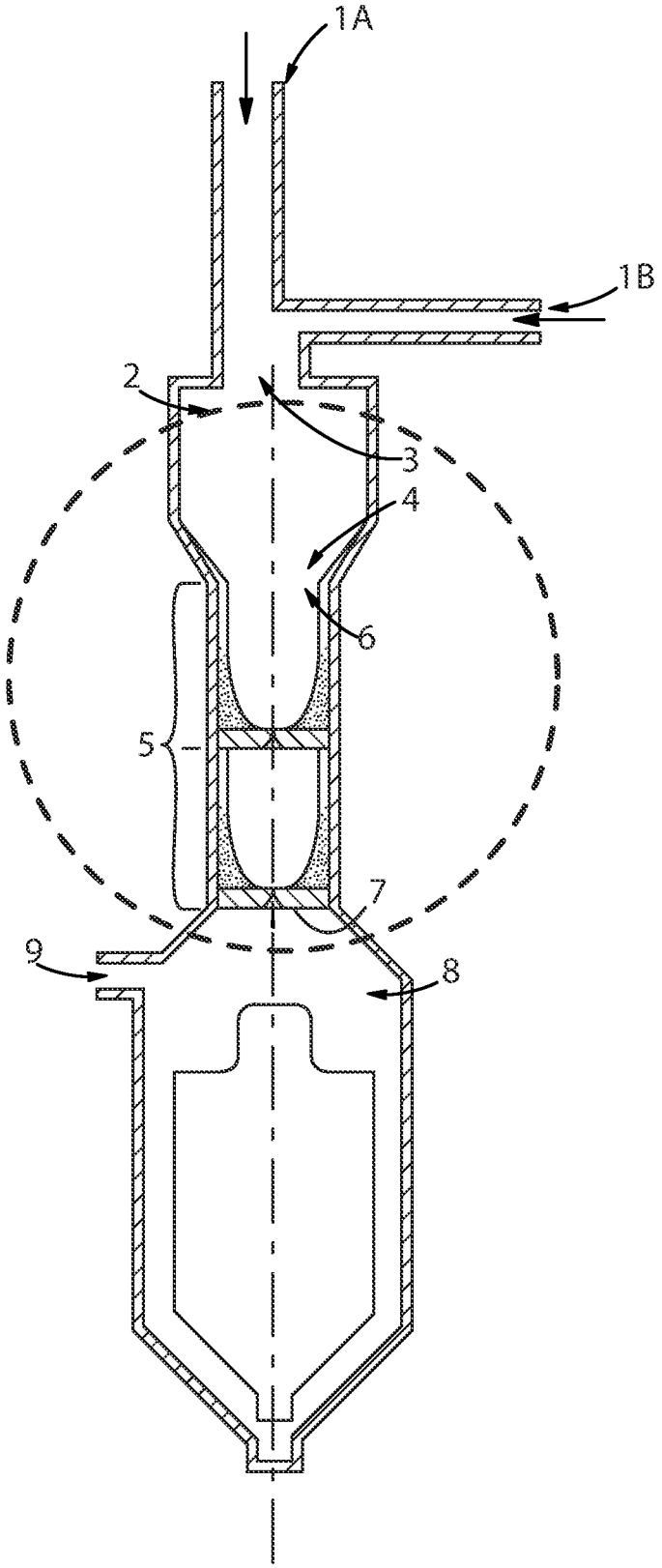
FIG. 1 details the apparatus A (see Methods).

As used herein, the articles including "a" and "an" when used in a claim, are understood to mean one or more of what is claimed or described.

As used herein, the terms "include", "includes" and "including" are meant to be non-limiting.

Unless otherwise noted, all component or composition levels are in reference to the active portion of that component or composition, and are exclusive of impurities, for example, residual solvents or by-products, which may be present in commercially available sources of such components or compositions. For example, it is known that quaternary ammonium esters typically contain the following impurities: the monoester form of the quaternary ammonium ester, residual non-reacted fatty acid, and non-quaternized esteramines.

All percentages and ratios are calculated by weight unless otherwise indicated. All percentages and ratios are calculated based on the total composition unless otherwise indicated.

All ratios are calculated as a weight/weight level of the active material, unless otherwise specified.

All measurements are performed at 25° C. unless otherwise specified.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

As used herein, the term "synthetic fabric" refers to fabrics made of materials selected from the list comprising polyester, nylon, spandex, acrylic, modacrylic, Kevlar®, and Nomex®.

In the context of the present invention the term "polyester" means both fabrics which comprise only polyester and blends of polyester with other materials, such as a "polycotton" blends.

The Liquid Fabric Softener Composition

As used herein, "liquid fabric softener composition" refers to any treatment composition comprising a liquid capable of softening fabrics e.g., clothing in a domestic washing machine. The composition can include solids or gases in suitably subdivided form, but the overall composition excludes product forms which are non-liquid overall, such as tablets or granules. The liquid fabric softener composition preferably has a density in the range from 0.9 to 1.3 $g \cdot cm^{-3}$, excluding any solid additives but including any bubbles, if present.

Aqueous liquid fabric softening compositions are preferred. For such aqueous liquid fabric softener compositions, the water content can be present at a level of from 50% to 97%, preferably from 60% to 96%, more preferably from 70% to 95% by weight of the liquid fabric softener composition.

The pH of the neat fabric softener composition is typically acidic to improve hydrolytic stability of the quaternary ammonium ester softening active and may be from pH 2.0 to 6.0, preferably from pH 2.0 to 4.5, more preferably from pH 2.0 to 3.5 (see Methods).

To provide a rich appearance while maintaining pourability of the fabrics softener composition, the viscosity of the fabric softener composition may be from 20 mPa·s to 1000 mPa·s, preferably from 50 mPa·s to 700 mPa·s, more preferably from 80 mPa·s to 500 mPa·s as measured with a Brookfield® DV-E rotational viscometer (see Methods).

To improve phase stability of the fabric softener composition, the dynamic yield stress (see Methods) at 20° C. of the fabric softener composition may be from 0.001 Pa to 1.0 Pa, preferably from 0.005 Pa to 0.8 Pa, more preferably from 0.01 Pa to 0.5 Pa. The absence of a dynamic yield stress may lead to phase instabilities such as particle creaming or settling in case the fabric softener composition comprises suspended particles such as encapsulated benefit agents. Very high dynamic yield stresses may lead to undesired air entrapment during filling of a bottle with the fabric softener composition.

The Quaternary Ammonium Ester Softening Active

The liquid fabric softener composition of the present invention comprises quaternary ammonium ester softening active (Fabric Softening Active, "FSA") to provide softness to treated fabrics.

In preferred liquid fabric softener compositions, the quaternary ammonium ester softening active is present at a level of from 3.0% to 25.0%, more preferably from 4.0% to 18%, even more preferably from 4.5% to 15% by weight of the composition. The level of quaternary ammonium ester softening active may depend of the desired concentration of total softening active in the composition (diluted or concentrated composition) and of the presence or not of other softening active. While higher FSA levels improve the softness benefits, the risk on instabilities is typically higher in fabric softener compositions with higher FSA levels.

Suitable quaternary ammonium ester softening actives include but are not limited to, materials selected from the group consisting of monoester quats, diester quats, triester quats and mixtures thereof. Preferably, the level of monoester quat is from 2.0% to 40.0%, the level of diester quat is from 40.0% to 98.0%, the level of triester quat is from 0.0% to 25.0% by weight of total quaternary ammonium ester softening active.

Said quaternary ammonium ester softening active may comprise compounds of the following formula:

$$\{R^2_{(4-m)}-N+-[X-Y-R^1]_m\}A^-$$

wherein:

m is 1, 2 or 3 with proviso that the value of each m is identical;

each $R^1$ is independently hydrocarbyl, or branched hydrocarbyl group, preferably $R^1$ is linear, more preferably $R^1$ is partially unsaturated linear alkyl chain;

each $R^2$ is independently a $C_1$-$C_3$ alkyl or hydroxyalkyl group, preferably $R^2$ is selected from methyl, ethyl, propyl, hydroxyethyl, 2-hydroxypropyl, 1-methyl-2-hydroxyethyl, poly($C_{2-3}$ alkoxy), polyethoxy, benzyl;

each X is independently —$(CH_2)$n-, —$CH_2$—CH$(CH_3)$— or —CH—$(CH_3)$—$CH_2$— and each n is independently 1, 2, 3 or 4, preferably each n is 2;

each Y is independently —O—(O)C— or —C(O)—O—;

$A^-$ is independently selected from the group consisting of chloride, methyl sulfate, and ethyl sulfate, preferably A- is selected from the group consisting of chloride and methyl sulfate;

with the proviso that when Y is —O—(O)C—, the sum of carbons in each $R^1$ is from 13 to 21, preferably from 13 to 19. Preferably, X is —$CH_2$—CH$(CH_3)$— or —CH—$(CH_3)$—$CH_2$— to improve the hydrolytic stability of the quaternary ammonium ester softening active, and hence further improve the stability of the fabric softener composition.

In preferred liquid fabric softener compositions the iodine value of the parent fatty acid from which the quaternary ammonium fabric softening active is formed is from 0 to 100, more preferably from 10 to 60, even more preferably from 15 to 45.

Examples of suitable quaternary ammonium ester softening actives are commercially available from KAO Chemicals under the trade name Tetranyl AT-1 and Tetranyl AT-7590, from Evonik under the tradename Rewoquat WE16 DPG, Rewoquat WE18, Rewoquat WE20, Rewoquat WE28, and Rewoquat 38 DPG, from Stepan under the tradename Stepantex GA90, Stepantex VR90, Stepantex VK90, Stepantex VA90, Stepantex DC90, Stepantex VL90A.

These types of agents and general methods of making them are disclosed in U.S. Pat. No. 4,137,180.

Cellulose Fibers:

The liquid fabric softener composition of the present invention comprises cellulose fibers. Cellulose fibers act as deposition aids for encapsulated benefit agents. Furthermore, cellulose fibers thicken and structure the fabric softener compositions enabling suspension of particles such as benefit agent capsules to provide benefits to treated fabrics.

Preferably, the composition of the present invention comprises from 0.01% to 5.0%, more preferably 0.05% to 1.0%, even more preferably from 0.1% to 0.75% of cellulose fibers by weight of the composition.

By cellulose fibers it is meant herein cellulose micro or nano fibrils. The cellulose fibers can be of bacterial or botanical origin, i.e. produced by fermentation or extracted from vegetables, plants, fruits or wood. Cellulose fiber sources may be selected from the group consisting of citrus peels, such as lemons, oranges and/or grapefruit; fruits, such as apples, bananas and/or pear; vegetables such as carrots, peas, potatoes and/or chicory; plants such as bamboo, jute, abaca, flax, cotton and/or sisal, cereals, and different wood sources such as spruces, eucalyptus and/or oak. Preferably, the cellulose fibers source is selected from the group consisting of wood or plants, in particular, spruce, eucalyptus, jute, and sisal.

The content of cellulose in the cellulose fibers will vary depending on the source and treatment applied for the extraction of the fibers, and will typically range from 15% to 100%, preferably above 30%, more preferably above 50%, and even more preferably above 80% of cellulose by weight of the cellulose fibers.

Such cellulose fibers may comprise pectin, hemicellulose, proteins, lignin and other impurities inherent to the cellulose based material source such as ash, metals, salts and combinations thereof. The cellulose fibers are preferably essentially non-ionic. Such fibers are commercially available, for instance Citri-Fi 100FG from Fiberstar, Herbacel® Classic from Herbafood, and Exilva® from Borregaard.

The cellulose fibers may have an average diameter from 10 nm to 350 nm, preferably from 30 nm to 250 nm, more preferably from 50 nm to 200 nm.

Non-Ionic Surfactants

The liquid fabric softener composition may comprise from 0.01% to 5.0%, preferably from 0.1% to 3.0%, more preferably from 0.5% to 2.0% of non-ionic surfactant based on the total fabric softener composition weight. Non-ionic surfactants further improve the stability when the liquid fabric softener composition has been exposed to freezing temperatures. Very high levels of non-ionic surfactant may lead to phase instabilities.

In preferred liquid fabric softener compositions the ratio by weight of quaternary ammonium ester softening active to non-ionic surfactant to is from 3:1 to 500:1, more preferably from 5:1 to 50:1, even more preferably from 10:1 to 40:1.

In preferred liquid fabric softener compositions the non-ionic surfactant is an alkoxylated non-ionic surfactant, preferably an ethoxylated non-ionic surfactant. Preferably the alkoxylated non-ionic surfactant has an average degree of alkoxylation of at least 3, preferably from 5 to 100, more preferably from 10 to 60.

Preferably ethoxylated non-ionic surfactant, more preferably an ethoxylated non-ionic surfactant having a hydrophobic lipophilic balance value of 8 to 18.

Examples of suitable non-ionic surfactants are commercially available from BASF under the tradename Lutensol AT80 (ethoxylated alcohol with an average degree of ethoxylation of 80 from BASF), from Clariant under the tradename Genapol T680 (ethoxylated alcohol with an average degree of ethoxylation of 68), from Sigma Aldrich under the tradename Tween 20 (polysorbate with an average degree of ethoxylation of 20), from The Dow Chemical Company under the tradename Tergitol 15-S-30 (ethoxylated branched alcohol with an average degree of ethoxylation of 30), from Clariant under trade name Genapol X407 (ethoxylated branched alcohol with an average degree of ethoxylation of 40).

Dispersed Perfume

The liquid fabric softener composition of the present invention may comprise a dispersed perfume composition. Dispersed perfume is typically added to provide the fabric softener composition with a pleasant smell. By dispersed perfume we herein mean a perfume composition that is freely dispersed in the fabric softener composition and is not encapsulated. A perfume composition comprises one or more perfume raw materials. Perfume raw materials are the individual chemical compounds that are used to make a perfume composition. The choice of type and number of perfume raw materials is dependent upon the final desired scent. In the context of the present invention, any suitable perfume composition may be used. Those skilled in the art will recognize suitable compatible perfume raw materials for use in the perfume composition, and will know how to select combinations of ingredients to achieve desired scents.

Preferably, the dispersed perfume is at a level of from 0.1% to 5.0%, more preferably 0.5% to 4.0%, even more preferably from 0.8% to 3.5%, most preferably from 1% to 3% by weight of the composition.

The perfume composition may comprise from 2.5% to 30%, preferably from 5% to 30% by weight of perfume composition of perfume raw materials characterized by a log P lower than 3.0, and a boiling point lower than 250° C.

The perfume composition may comprise from 5% to 30%, preferably from 7% to 25% by weight of perfume composition of perfume raw materials characterized by having a log P lower than 3.0 and a boiling point higher than 250° C. The perfume composition may comprise from 35% to 60%, preferably from 40% to 55% by weight of perfume composition of perfume raw materials characterized by having a log P higher than 3.0 and a boiling point lower than 250° C. The perfume composition may comprise from 10% to 45%, preferably from 12% to 40% by weight of perfume composition of perfume raw materials characterized by having a log P higher than 3.0 and a boiling point higher than 250° C.

Particles

The liquid fabric softener composition of the present invention also comprises particles. The liquid fabric softener composition may comprise, based on the total liquid fabric softener composition weight, from 0.02% to 10%, preferably from 0.1% to 4%, more preferably from 0.25% to 2.5% of particles. Said particles include beads, pearlescent agents, benefit agent capsules, and mixtures thereof.

Polyacrylate Based Capsules Encapsulating Benefit Agent

The liquid fabric softener composition comprises benefit agent capsules comprising a core and a shell encapsulating said core wherein said shell comprises polyacrylate polymer. The shell may include from about 50% to about 100%, or from about 70% to about 100%, or from about 80% to about 100% of a polyacrylate polymer. The polyacrylate may include a polyacrylate cross linked polymer.

Benefit agent capsules comprise an outer shell defining a core in which a benefit agent is held until rupture of the shell.

The shell material may include a material selected from the group consisting of a polyacrylate, a polyethylene glycol acrylate, a polyurethane acrylate, an epoxy acrylate, a polymethacrylate, a polyethylene glycol methacrylate, a polyurethane methacrylate, an epoxy methacrylate, and mixtures thereof.

The shell material of the capsules may include a polymer derived from a material that comprises one or more multifunctional acrylate moieties. The multifunctional acrylate moiety may be selected from the group consisting of trifunctional acrylate, tetra-functional acrylate, penta-functional acrylate, hexa-functional acrylate, hepta-functional acrylate and mixtures thereof. The multifunctional acrylate moiety is preferably hexa-functional acrylate. The shell material may include a polyacrylate that comprises a moiety selected from the group consisting of an acrylate moiety, methacrylate moiety, amine acrylate moiety, amine methacrylate moiety, a carboxylic acid acrylate moiety, carboxylic acid methacrylate moiety and combinations thereof, preferably an amine methacrylate or carboxylic acid acrylate moiety.

The shell material may include a material that comprises one or more multifunctional acrylate and/or methacrylate moieties. The ratio of material that comprises one or more multifunctional acrylate moieties to material that comprises one or more methacrylate moieties may be from about 999:1 to about 6:4, preferably from about 99:1 to about 8:1, more preferably from about 99:1 to about 8.5:1.

The core/shell capsule may comprise an emulsifier, wherein the emulsifier is preferably selected from anionic emulsifiers, nonionic emulsifiers, cationic emulsifiers or mixtures thereof, preferably nonionic emulsifiers.

The core/shell capsule may comprise from 0.1% to 1.1% by weight of the core/shell capsule of polyvinyl alcohol. Preferably, the polyvinyl alcohol has at least one the following properties, or a mixture thereof:

(i) a hydrolysis degree from 55% to 99%;

(ii) a viscosity of from 40 mPa·s to 120 mPa·s in 4% water solution at 20° C.;

(iii) a degree of polymerization of from 1,500 to 2,500;

(iv) number average molecular weight of from 65,000 Da to 110,000 Da.

The core/shell capsule may comprise an emulsifier, wherein the emulsifier is preferably selected from styrene maleic anhydride copolymer, styrene maleic anhydride monomethylmaleate, and/or a salt thereof, in one aspect, styrene maleic anhydride monomethylmaleate di-sodium salt and/or styrene maleic anhydride monomethylmaleate ammonia-salt; in one aspect, said styrene maleic anhydride monomethylmaleate, and/or a salt thereof.

Perfume compositions are the preferred encapsulated benefit agent. The perfume composition comprises perfume raw materials. The encapsulated benefit agent may further comprise essential oils, malodour reducing agents, odour controlling agents, silicone, and combinations thereof.

The perfume raw materials are typically present in an amount of from 10% to 95%, preferably from 20% to 90% by weight of the capsule.

The perfume composition may comprise from 2.5% to 30%, preferably from 5% to 30% by weight of perfume composition of perfume raw materials characterized by a log P lower than 3.0, and a boiling point lower than 250° C.

The perfume composition may comprise from 5% to 30%, preferably from 7% to 25% by weight of perfume composition of perfume raw materials characterized by having a log P lower than 3.0 and a boiling point higher than 250° C. The perfume composition may comprise from 35% to 60%, preferably from 40% to 55% by weight of perfume composition of perfume raw materials characterized by having a log P higher than 3.0 and a boiling point lower than 250° C. The perfume composition may comprise from 10% to 45%, preferably from 12% to 40% by weight of perfume composition of perfume raw materials characterized by having a log P higher than 3.0 and a boiling point higher than 250° C.

Preferably, the core also comprises a partitioning modifier. Suitable partitioning modifiers include vegetable oil, modified vegetable oil, propan-2-yl tetradecanoate and mixtures thereof. The modified vegetable oil may be esterified and/or brominated. The vegetable oil comprises castor oil and/or soy bean oil. The partitioning modifier may be propan-2-yl tetradecanoate. The partitioning modifier may be present in the core at a level, based on total core weight, of greater than 20%, or from greater than 20% to about 80%, or from greater than 20% to about 70%, or from greater than 20% to about 60%, or from about 30% to about 60%, or from about 30% to about 50%.

Preferably the core/shell capsule have a volume weighted mean particle size from 0.5 microns to 100 microns, preferably from 1 micron to 60 microns, even more preferably from 5 microns to 30 microns.

Ratio of Encapsulated Benefit Agent to Dispersed Perfume Oil

The liquid fabric softener composition may comprise a ratio of encapsulated benefit agent to dispersed perfume oil by weight of from 1:1 to 1:40, preferably from 1:2 to 1:20, more preferably from 1:3 to 1:10 to improve the freshness of treated fabrics at both the wet and the dry stage.

Additional Capsules Encapsulating Benefit Agent

The liquid fabric softener composition may comprise benefit agent capsules comprising a core and a shell encapsulating said core wherein the shell may include a material selected from the group consisting of polyethylenes; polyamides; polystyrenes; polyisoprenes; polycarbonates; polyesters; acrylics; aminoplasts; polyolefins; polysaccharides, such as alginate and/or chitosan; gelatin; shellac; epoxy resins; vinyl polymers; water insoluble inorganics; silicone; and mixtures thereof.

The shell material may include an aminoplast. The aminoplast may include a polyurea, polyurethane, and/or polyureaurethane. The aminoplast may include an aminoplast copolymer, such as melamine-formaldehyde, urea-formaldehyde, cross-linked melamine formaldehyde, or mixtures thereof. The shell may include melamine formaldehyde, which may further include a coating as described below. The capsule may include a core that comprises perfume, and a shell that includes melamine formaldehyde and/or cross linked melamine formaldehyde. The capsule may include a core that comprises perfume, and a shell that comprises melamine formaldehyde and/or cross linked melamine formaldehyde, poly(acrylic acid) and poly(acrylic acid-co-butyl acrylate).

Perfume compositions are the preferred encapsulated benefit agent. The perfume composition comprises perfume raw materials. The encapsulated benefit agent may further comprise essential oils, malodour reducing agents, odour controlling agents, silicone, and combinations thereof.

Additional Fabric Softening Active

The liquid fabric softener composition of the present invention may comprise from 0.01% to 10%, preferably from 0.1% to 10%, more preferably from 0.1% to 5% of additional fabric softening active. Suitable fabric softening actives, include, but are not limited to, materials selected from the group consisting of non-ester quaternary ammonium compounds, amines, fatty esters, sucrose esters, silicones, dispersible polyolefins, polysaccharides, fatty acids, softening oils, polymer latexes and combinations thereof.

Non-Ester Quaternary Ammonium Compounds:

Suitable non-ester quaternary ammonium compounds comprise compounds of the formula:

$$[R_{(4-m)}-N^{+}-R^{1}_{m}]X^{-}$$

wherein each R comprises either hydrogen, a short chain $C_1$-$C_6$, in one aspect a $C_1$-$C_3$ alkyl or hydroxyalkyl group, for example methyl, ethyl, propyl, hydroxyethyl, poly($C_{2-3}$ alkoxy), polyethoxy, benzyl, or mixtures thereof; each m is 1, 2 or 3 with the proviso that the value of each m is the same; the sum of carbons in each $R^1$ may be $C_{12}$-$C_{22}$, with each $R^1$ being a hydrocarbyl, or substituted hydrocarbyl group; and $X^-$ may comprise any softener-compatible anion. The softener-compatible anion may comprise chloride, bromide, methylsulfate, ethylsulfate, sulfate, and nitrate. The softener-compatible anion may comprise chloride or methyl sulfate.

Non-limiting examples include dialkylenedimethylammonium salts such as dicanoladimethylammonium chloride, di(hard)tallowdimethylammonium chloride dicanoladimethylammonium methylsulfate, and mixtures thereof. An example of commercially available dialkylenedimethylammonium salts usable in the present invention is dioleyldimethylammonium chloride available from Witco Corporation under the trade name Adogen® 472 and dihardtallow dimethylammonium chloride available from Akzo Nobel Arquad 2HT75.

Amines:

Suitable amines include but are not limited to, materials selected from the group consisting of amidoesteramines, amidoamines, imidazoline amines, alkyl amines, and combinations thereof. Suitable ester amines include but are not limited to, materials selected from the group consisting of monoester amines, diester amines, triester amines and combinations thereof. Suitable amidoamines include but are not limited to, materials selected from the group consisting of monoamido amines, diamido amines and combinations thereof. Suitable alkyl amines include but are not limited to, materials selected from the group consisting of mono alkylamines, dialkyl amines quats, trialkyl amines, and combinations thereof.

Fatty Acid:

The liquid fabric softener composition may comprise a fatty acid, such as a free fatty acid as fabric softening active. The term "fatty acid" is used herein in the broadest sense to include unprotonated or protonated forms of a fatty acid. One skilled in the art will readily appreciate that the pH of an aqueous composition will dictate, in part, whether a fatty acid is protonated or unprotonated. The fatty acid may be in its unprotonated, or salt form, together with a counter ion such as, but not limited to, calcium, magnesium, sodium, potassium, and the like. The term "free fatty acid" means a fatty acid that is not bound to another chemical moiety (covalently or otherwise).

The fatty acid may include those containing from 12 to 25, from 13 to 22, or even from 16 to 20, total carbon atoms, with the fatty moiety containing from 10 to 22, from 12 to 18, or even from 14 (mid-cut) to 18 carbon atoms.

The fatty acids may be derived from (1) an animal fat, and/or a partially hydrogenated animal fat, such as beef tallow, lard, etc.; (2) a vegetable oil, and/or a partially hydrogenated vegetable oil such as canola oil, safflower oil, peanut oil, sunflower oil, sesame seed oil, rapeseed oil, cottonseed oil, corn oil, soybean oil, tall oil, rice bran oil, palm oil, palm kernel oil, coconut oil, other tropical palm oils, linseed oil, tung oil, castor oil, etc.; (3) processed and/or bodied oils, such as linseed oil or tung oil via thermal, pressure, alkali-isomerization and catalytic treatments; (4) combinations thereof, to yield saturated (e.g. stearic acid), unsaturated (e.g. oleic acid), polyunsaturated (linoleic acid), branched (e.g. isostearic acid) or cyclic (e.g. saturated or unsaturated α-disubstituted cyclopentyl or cyclohexyl derivatives of polyunsaturated acids) fatty acids.

Mixtures of fatty acids from different fat sources can be used.

The cis/trans ratio for the unsaturated fatty acids may be important, with the cis/trans ratio (of the C18:1 material) being from at least 1:1, at least 3:1, from 4:1 or even from 9:1 or higher.

Branched fatty acids such as isostearic acid are also suitable since they may be more stable with respect to oxidation and the resulting degradation of color and odor quality. The fatty acid may have an iodine value from 0 to 140, from 50 to 120 or even from 85 to 105.

Polysaccharides:

The liquid fabric softener composition may comprise a polysaccharide as a fabric softening active, such as cationic starch. Suitable cationic starches for use in the present compositions are commercially-available from Cerestar under the trade name C*BOND® and from National Starch and Chemical Company under the trade name CATO® 2A.

Sucrose Esters:

The liquid fabric softener composition may comprise a sucrose esters as a fabric softening active. Sucrose esters are typically derived from sucrose and fatty acids. Sucrose ester is composed of a sucrose moiety having one or more of its hydroxyl groups esterified.

Sucrose is a disaccharide having the following formula:

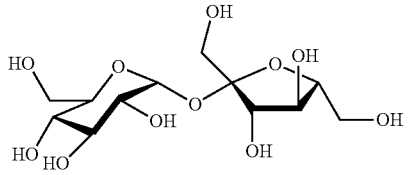

Alternatively, the sucrose molecule can be represented by the formula: $M(OH)_8$, wherein M is the disaccharide backbone and there are total of 8 hydroxyl groups in the molecule.

Thus, sucrose esters can be represented by the following formula:

$$M(OH)_{8-x}(OC(O)R^1)_x$$

wherein x is the number of hydroxyl groups that are esterified, whereas (8-x) is the hydroxyl groups that remain unchanged; x is an integer selected from 1 to 8, alternatively from 2 to 8, alternatively from 3 to 8, or from 4 to 8; and $R^1$ moieties are independently selected from $C_1$-$C_{22}$ alkyl or $C_1$-$C_{30}$ alkoxy, linear or branched, cyclic or acyclic, saturated or unsaturated, substituted or unsubstituted.

The $R^1$ moieties may comprise linear alkyl or alkoxy moieties having independently selected and varying chain length. For example, $R^1$ may comprise a mixture of linear alkyl or alkoxy moieties wherein greater than 20% of the linear chains are $C_{18}$, alternatively greater than 50% of the linear chains are $C_{18}$, alternatively greater than 80% of the linear chains are $C_{18}$.

The $R^1$ moieties may comprise a mixture of saturate and unsaturated alkyl or alkoxy moieties. The iodine value of the sucrose esters suitable for use herein ranges from 1 to 150, or from 2 to 100, or from 5 to 85. The $R^1$ moieties may be hydrogenated to reduce the degree of unsaturation. In the case where a higher iodine value is preferred, such as from 40 to 95, then oleic acid and fatty acids derived from soybean oil and canola oil are suitable starting materials.

The unsaturated $R^1$ moieties may comprise a mixture of "cis" and "trans" forms the unsaturated sites. The "cis"/"trans" ratios may range from 1:1 to 50:1, or from 2:1 to 40:1, or from 3:1 to 30:1, or from 4:1 to 20:1.

Dispersible Polyolefins and Latexes:

Generally, all dispersible polyolefins that provide fabric softening benefits can be used as fabric softening active in the present invention. The polyolefins can be in the form of waxes, emulsions, dispersions or suspensions.

The polyolefin may be chosen from a polyethylene, polypropylene, or combinations thereof. The polyolefin may be at least partially modified to contain various functional groups, such as carboxyl, alkylamide, sulfonic acid or amide groups. The polyolefin may be at least partially carboxyl modified or, in other words, oxidized.

Non-limiting examples of fabric softening active include dispersible polyethylene and polymer latexes. These agents can be in the form of emulsions, latexes, dispersions, suspensions, and the like. In one aspect, they are in the form of an emulsion or a latex. Dispersible polyethylenes and polymer latexes can have a wide range of particle size diameters ($\chi_{50}$) including but not limited to from 1 nm to 100 μm; alternatively from 10 nm to 10 μm. As such, the particle sizes of dispersible polyethylenes and polymer latexes are generally, but without limitation, smaller than silicones or other fatty oils.

Generally, any surfactant suitable for making polymer emulsions or emulsion polymerizations of polymer latexes can be used as emulsifiers for polymer emulsions and latexes used as fabric softeners active in the present invention. Suitable surfactants include anionic, cationic, and nonionic surfactants, and combinations thereof. In one aspect, such surfactants are nonionic and/or anionic surfactants. In one aspect, the ratio of surfactant to polymer in the fabric softening active is 1:5, respectively.

Silicone:

The liquid fabric softener composition may comprise a silicone as fabric softening active. Useful silicones can be any silicone comprising compound. The silicone polymer may be selected from the group consisting of cyclic silicones, polydimethylsiloxanes, aminosilicones, cationic silicones, silicone polyethers, silicone resins, silicone urethanes, and combinations thereof. The silicone may be a polydialkylsilicone, alternatively a polydimethyl silicone (polydimethyl siloxane or "PDMS"), or a derivative thereof. The silicone may be chosen from an aminofunctional silicone, amino-polyether silicone, alkyloxylated silicone, cationic silicone, ethoxylated silicone, propoxylated silicone, ethoxylated/propoxylated silicone, quaternary silicone, or combinations thereof.

Further Perfume Delivery Technologies

The liquid fabric softener composition may comprise one or more perfume delivery technologies that stabilize and enhance the deposition and release of perfume ingredients from treated substrate. Such perfume delivery technologies can be used to increase the longevity of perfume release from the treated substrate. Perfume delivery technologies, methods of making certain perfume delivery technologies and the uses of such perfume delivery technologies are disclosed in US 2007/0275866 A1.

The liquid fabric softener composition may comprise from 0.001% to 20%, or from 0.01% to 10%, or from 0.05% to 5%, or even from 0.1% to 0.5% by weight of the perfume delivery technology. Said perfume delivery technologies may be selected from the group consisting of: pro-perfumes, cyclodextrins, starch encapsulated accord, zeolite and inorganic carrier, and combinations thereof.

Amine Reaction Product (ARP): For purposes of the present application, ARP is a subclass or species of pro-perfumes. One may also use "reactive" polymeric amines in which the amine functionality is pre-reacted with one or more PRMs to form an amine reaction product (ARP). Typically the reactive amines are primary and/or secondary amines, and may be part of a polymer or a monomer (non-polymer). Such ARPs may also be mixed with additional PRMs to provide benefits of polymer-assisted delivery and/or amine-assisted delivery. Non-limiting examples of polymeric amines include polymers based on polyalkylimines, such as polyethyleneimine (PEI), or polyvinylamine (PVAm). Non-limiting examples of monomeric (non-polymeric) amines include hydroxyl amines, such as 2-aminoethanol and its alkyl substituted derivatives, and aromatic amines such as anthranilates. The ARPs may be premixed with perfume or added separately in leave-on or rinse-off applications. A material that contains a heteroatom other than nitrogen, for example oxygen, sulfur, phosphorus or selenium, may be used as an alternative to amine compounds. The aforementioned alternative compounds can be used in combinations with amine compounds. A single molecule may comprise an amine moiety and one or more of the alternative heteroatom moieties, for example, thiols, and phosphines. The benefit may include improved delivery of perfume as well as controlled perfume release.

Deposition Aid

The liquid fabric softener composition may comprise, based on the total liquid fabric softener composition weight, from 0.0001% to 3%, preferably from 0.0005% to 2%, more preferably from 0.001% to 1% of a deposition aid. The deposition aid may be a cationic or amphoteric polymer. The cationic polymer may comprise a cationic acrylate. Cationic polymers in general and their method of manufacture are known in the literature. Deposition aids can be added concomitantly with particles or directly in the liquid fabric softener composition. Preferably, the deposition aid is selected from the group consisting of polyvinylformamide, partially hydroxylated polyvinylformamide, polyvinylamine, polyethylene imine, ethoxylated polyethylene imine, polyvinylalcohol, polyacrylates, polysaccharides and combinations thereof.

The weight-average molecular weight of the polymer may be from 500 to 5000000 or from 1000 to 2000000 or from 2500 to 1500000 Dalton, as determined by size exclusion chromatography relative to polyethyleneoxide standards using Refractive Index (RI) detection. In one aspect, the weight-average molecular weight of the cationic polymer may be from 5000 to 37500 Dalton.

Dyes and Pigments

The liquid fabric softener composition may comprise adjunct ingredients suitable for use in the instant compositions and may be desirably incorporated in certain aspects of the invention, for example to improve the aesthetics of the composition as is the case with pigments and dyes. Moreover, liquid fabric softener compositions comprising unsaturated quaternary ammonium ester softening actives are subject to some degree of UV light and/or oxidation which increases the risk on yellowing of the fabric softener composition as well as yellowing of treated fabrics. However, especially in the presence of a dye phase instabilities become more apparent. The liquid fabric softener composition may comprise from 0.0001% to 0.1%, preferably from 0.001% to 0.05% of a dye by weight of the composition. Suitable dyes are selected from the list comprising bis-azo dyes, tris-azo dyes, acid dyes, azine dyes, hydrophobic dyes, methane basic dyes, anthraquinone basic dyes, and dye conjugates formed by binding acid or basic dyes to polymers.

Methods

Method of Determining pH of a Fabric Softener Composition

The pH is measured on the neat fabric softener composition, using a Sartorius PT-10P pH meter with gel-filled probe (such as the Toledo probe, part number 52 000 100), calibrated according to the instructions manual.

Method of Determining Viscosity of a Fabric Softener Composition

The viscosity of neat fabric softener composition is determined using a Brookfield® DV-E rotational viscometer, at 60 rpm, at 21° C. Spindle 2 is used for viscosities from 50 mPa·s to 400 mPa·s. Spindle 3 is used for viscosities from 401 mPa·s to 2.0 Pa·s.

Method for Determining Dynamic Yield Stress

Dynamic yield stress is measured using a controlled stress rheometer (such as an HAAKE MARS from Thermo Scientific, or equivalent), using a 60 mm parallel plate and a gap size of 500 microns at 20° C. The dynamic yield stress is obtained by measuring quasi steady state shear stress as a function of shear rate starting from 10 $s^{-1}$ to $10^{-4}$ $s^{-1}$, taking 25 points logarithmically distributed over the shear rate range. Quasi-steady state is defined as the shear stress value once variation of shear stress over time is less than 3%, after at least 30 seconds and a maximum of 60 seconds at a given shear rate. Variation of shear stress over time is continuously evaluated by comparison of the average shear stress measured over periods of 3 seconds. If after 60 seconds measurement at a certain shear rate, the shear stress value varies more than 3%, the final shear stress measurement is defined as the quasi state value for calculation purposes. Shear stress data is then fitted using least squares method in logarithmic space as a function of shear rate following a Herschel-Bulkley model:

$$\tau=\tau_0+k\dot{\gamma}^n$$

wherein $\tau$ is the measured equilibrium quasi steady state shear stress at each applied shear rate $\dot{\gamma}$, $\tau_0$ is the fitted dynamic yield stress. k and n are fitting parameters.

Method of Measuring Iodine Value of a Quaternary Ammonium Ester Fabric Softening Active:

The iodine value of a quaternary ammonium ester fabric softening active is the iodine value of the parent fatty acid from which the fabric softening active is formed, and is defined as the number of grams of iodine which react with 100 grams of parent fatty acid from which the fabric softening active is formed.

First, the quaternary ammonium ester fabric softening active is hydrolysed according to the following protocol: 25 g of fabric softener composition is mixed with 50 mL of water and 0.3 mL of sodium hydroxide (50% activity). This mixture is boiled for at least an hour on a hotplate while avoiding that the mixture dries out. After an hour, the mixture is allowed to cool down and the pH is adjusted to neutral (pH between 6 and 8) with sulfuric acid 25% using pH strips or a calibrated pH electrode.

Next the fatty acid is extracted from the mixture via acidified liquid-liquid extraction with hexane or petroleum ether: the sample mixture is diluted with water/ethanol (1:1) to 160 mL in an extraction cylinder, 5 grams of sodium chloride, 0.3 mL of sulfuric acid (25% activity) and 50 mL of hexane are added. The cylinder is stoppered and shaken for at least 1 minute. Next, the cylinder is left to rest until 2 layers are formed. The top layer containing the fatty acid in hexane is transferred to another recipient. The hexane is then evaporated using a hotplate leaving behind the extracted fatty acid.

Next, the iodine value of the parent fatty acid from which the fabric softening active is formed is determined following ISO3961:2013. The method for calculating the iodine value of a parent fatty acid comprises dissolving a prescribed amount (from 0.1-3 g) into 15 mL of chloroform. The dissolved parent fatty acid is then reacted with 25 mL of iodine monochloride in acetic acid solution (0.1M). To this, 20 mL of 10% potassium iodide solution and 150 mL deionised water is added. After the addition of the halogen has taken place, the excess of iodine monochloride is determined by titration with sodium thiosulphate solution (0.1M) in the presence of a blue starch indicator powder. At the same time a blank is determined with the same quantity of reagents and under the same conditions. The difference between the volume of sodium thiosulphate used in the blank and that used in the reaction with the parent fatty acid enables the iodine value to be calculated.

Method of Measuring Fatty Acid Chain Length Distribution

The fatty acid chain length distribution of the quaternary ammonium ester fabric softening active refers to the chain length distribution of the parent fatty acid from which the fabric softening active is formed. It can be measured on the quaternary ammonium ester softening active or on the fatty acid extracted from the fabric softener composition as described in the method to determine the iodine value of a quaternary ammonium ester fabric softening active. The fatty acid chain length distribution is measured by dissolving 0.2 g of the quaternary ammonium ester softening active or extracted fatty acid in 3 mL of 2-butanol, 3 glass beads are added and the sample is vortexed at high speed for 4 minutes. An aliquot of this extract is then transferred into a 2 mL gas chromatography vial, which is then injected into the gas chromatogram inlet (250° C.) of the gas chromatograph (Agilent GC6890N) and the resultant bi-products are separated on a DB-5 ms column (30 m×250 μm×1.0 μm, 2.0 mL/min). These bi-products are identified using a mass-spectrometer (Agilent MSD5973N, Chemstation Software version E.02.02) and the peak areas of the corresponding fatty acid chain lengths are measured. The fatty acid chain length distribution is determined by the relative ratios of the peak areas corresponding to each fatty acid chain length of interest as compared to the sum of all peaks corresponding to all fatty acid chain lengths.

Method for Determining Average Cellulose Fiber Diameter:

The average cellulose fiber diameter can be determined directly from the cellulose fiber raw material or from the fabric softener composition comprising cellulose fibers.

A) Cellulose fibers raw material: A cellulose fibers sample is prepared by adding 1% dry matter of cellulose fibers to water and activating it with a high pressure homogenizer (PANDA from GEA, 350 bars, 10 passes). The obtained sample is analyzed.

B) Fabric softener composition comprising cellulose fibers:

The fabric softener composition sample is centrifuged at 4,000 rpm for 10 minutes using a 5804 centrifuge from Eppendorf, in order to remove potential particles to avoid interference in the measurement of the fiber size. The clarified fabric softener composition is then decanted as the supernatant. The cellulose fibers present in the fabric softener composition (supernatant) are redispersed in ethanol using an Ultra Turrax device from IKA, T25 S 25 N-25 G-ST, at a speed of 21 000 rpm for 10 minutes. Then, sample is centrifuged at 4 000 rpm for 10 minutes using a 5804 centrifuge from Eppendorf and supernatant is removed. Remaining cellulose fibers at the bottom are analyzed. The process is repeated as many times as needed to have enough amount for the analysis.

Average cellulose fiber diameter is analysed using Atomic force microscopy (AFM). A 0.02% cellulose fiber dispersion in demineralized water is prepared, and a drop of this dispersion is deposited onto freshly cleaved mica (highest grade V1 Mica, 15×15 mm—TED PELLA, INC., or equivalent). The sample is then allowed to dry in an oven at 40° C.

The mica sheet is mounted in an AFM (Nanosurf Flex AFM, ST Instruments or equivalent) and imaged in air under ambient conditions using a Si cantilever in dynamic mode with dynamic mode tip (ACTA-50-APPNANO or equivalent). The image dimensions are 20 micron by 20 micron, and 256 points per line are captured.

The AFM image is opened using suitable AFM data analysis software (such as Mountainsmap SPM 7.3, ST Instruments, or equivalent). Each image is leveled line by line. One or more profiles are extracted crossing perpendicularly one or multiple fibers avoiding bundles of fibers, and from each profile, a distance measurement is performed to obtain the diameter of the fibers. Ten diameter measurements are performed per picture counting each fiber only once.

Three sets of measurements (sample preparation, AFM measurement and image analysis) are made. The arithmetic mean of all fibers measured in all images is the Average Cellulose Fiber Diameter.

Method for Treating Fabrics with Fabric Softener Composition Prior to Head Space Concentration Determination The method to treat fabrics with fabric softener composition comprises a fabric pretreatment phase followed by a fabric treatment phase.

Fabric Pretreatment Phase:

2.9±0.1 kg of ballast fabrics containing cotton, polyester, polycotton, 3 white knitted cotton fabric tracers (from Warwick Equest) and 3 white polyester tracers are washed 4 times with 50 g Non-perfumed Ariel Sensitive (Nordics) at 60° C. with 2 grains per gallon (gpg) water, 1 h 26 min cycle, 1600 rpm, in a front loader washing machine such as Miele (Novotronic W986/Softronic W467/W526/W527/W1614/W1714/W2261) or equivalent and then washed once with no detergent at 60° C. with 2 gpg water. After the last wash, fabrics are dried in a 5 Kg drum tumble drier with hot air outlet such as Miele Novotronic (T490/T220/T454/T430/T410/T7634) or equivalent and then they are ready to be used for testing.

Fabric Treatment Phase:

2.9±0.1 kg of ballast fabrics containing cotton, polyester, polycotton, 3 white knitted cotton fabric tracers (from Warwick Equest) and 3 white polyester tracers are washed in 15 gpg water at 40° C., 56 minutes cycle, 1200 rpm without laundry detergent to avoid interference in the fabric softener evaluation. The fabric softener composition is pre-diluted in 2 L of 15° C. water with a hardness of 15 gpg 5 min before the starting of the last rinse and added to the last rinse while the washing machine is taking the water. This is a requirement to ensure homogeneous dispensability over the load and minimize the variability of the test results. All fabrics are line dried in a control temperature (25° C.) and humidity (60%) room for 24 hours prior to head space concentration determination.

Method for Determining Head Space Concentration

The 3 white knitted cotton fabric tracers and 3 white polyester fabric tracers treated with fabric softener compositions (see Method for treating fabrics with fabric softener composition prior to head space concentration determination) are used for the analysis. A piece of 5×5 cm is gently cut from the center of each fabric tracer and analyzed by fast head space gas chromatography/mass spectroscopy ("GC/MS") using an Agilent DB-5UI 30 m×0.25×0.25 column (part #122-5532UI) in splitless mode. Each fabric tracer cut is transferred into 25 mL glass headspace vials. The fabric samples are allowed to equilibrate for 10 minutes at 65° C. before the headspace above the fabrics is sampled using a 23 gauge 50/30UM DVB/CAR/PDMS SPME fiber (Sigma-Aldrich part #57298-U) for 5 minutes. The SPME fiber is subsequently on-line thermally desorbed into the GC using a ramp from 40° C. (0.5 min) to 270° C. (0.25 min) at 17° C./min. The perfume raw materials with a molecular weight between 35 and 300 m/z are analyzed by fast GC/MS in full scan mode. The amount of perfume in the headspace is expressed as nmol/L.

Method of Determining Partition Coefficient

The partition coefficient, P, is the ratio of concentrations of a compound in a mixture of two immiscible phases at equilibrium, in this case n-Octanol/Water. The value of the log of the n-Octanol/Water Partition Coefficient (log P) can be measured experimentally using well known means, such as the "shake-flask" method, measuring the distribution of the solute by UV/VIS spectroscopy (for example, as described in "The Measurement of Partition Coefficients", Molecular Informatics, Volume 7, Issue 3, 1988, Pages 133-144, by Dearden J C, Bresnan). Alternatively, the log P can be computed for each PRM in the perfume mixture being tested. The log P of an individual PRM is preferably calculated using the Consensus log P Computational Model, version 14.02 (Linux) available from Advanced Chemistry Development Inc. (ACD/Labs) (Toronto, Canada) to provide the unitless log P value. The ACD/Labs' Consensus log P Computational Model is part of the ACD/Labs model suite.

Processes of Making the Fabric Softener Composition of the Invention

The compositions of the present invention can be formulated into any suitable form and prepared by any process chosen by the formulator, non-limiting examples of which are described in Applicant's examples and in US 2013/0109612 A1 which is incorporated herein by reference.

The compositions disclosed herein may be prepared by combining the components thereof in any convenient order and by mixing, e.g., agitating, the resulting component combination to form a phase stable fabric care composition. A fluid matrix may be formed containing at least a major proportion, or even substantially all, of the fluid components with the fluid components being thoroughly admixed by imparting shear agitation to this liquid combination. For example, rapid stirring with a mechanical stirrer may be employed.

Figure 2:
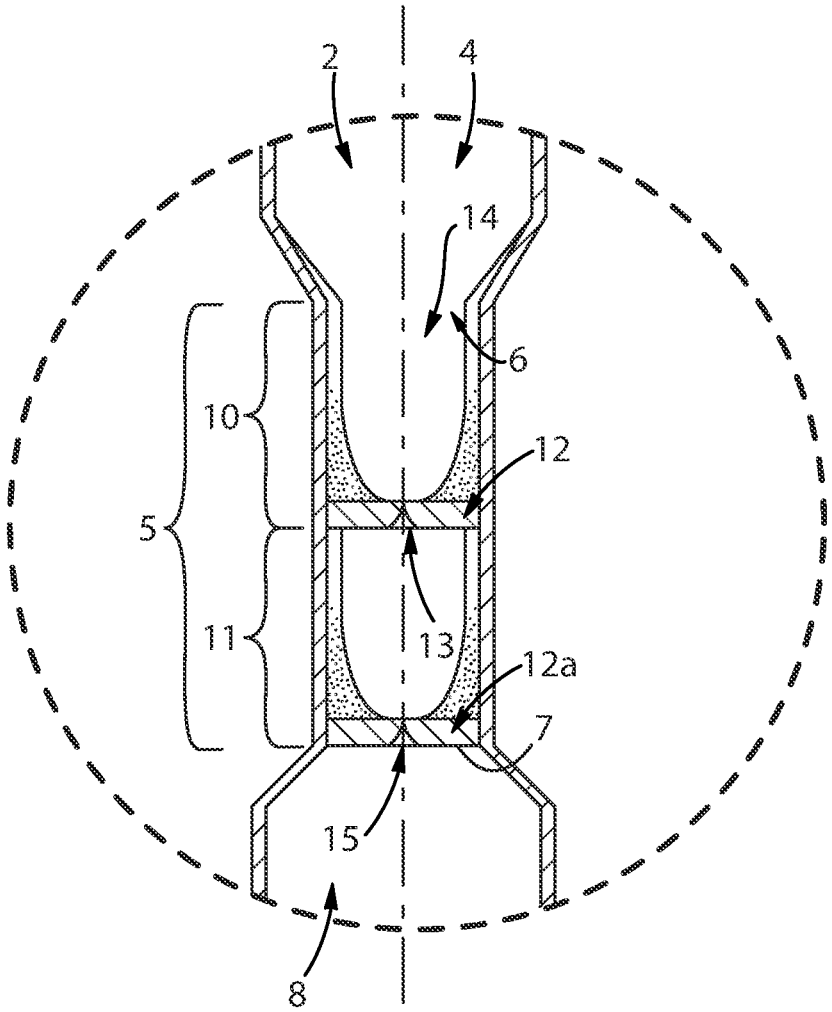
FIG. 2 details the orifice component 5 of Apparatus A (see Methods).

The liquid fabric softener compositions described herein can also be made as follows:

Taking an apparatus A (see FIG. 1) comprising:

at least a first inlet 1A and a second inlet 1B; a pre-mixing chamber 2, the pre-mixing chamber 2 having an upstream end 3 and a downstream end 4, the upstream end 3 of the pre-mixing chamber 2 being in liquid communication with the first inlet 1A and the second inlet 1B; an orifice component 5, the orifice component 5 having an upstream end 6 and a downstream end 7, the upstream end of the orifice component 6 being in liquid communication with the downstream end 4 of the pre-mixing chamber 2, wherein the orifice component 5 is configured to spray liquid in a jet and produce shear and/or turbulence in the liquid; a secondary mixing chamber 8, the secondary mixing chamber 8 being in liquid communication with the downstream end 7 of the orifice component 5; at least one outlet 9 in liquid communication with the secondary mixing chamber 8 for discharge of liquid following the production of shear and/or turbulence in the liquid, the inlet 1A, pre-mixing chamber 2, the orifice component 5 and secondary mixing chamber 8 are linear and in straight line with each other, at least one outlet 9 being located at the downstream end of the secondary mixing chamber 8; the orifice component 5 comprising at least one orifice unit, a specific example, as shown in FIG. 2, is that the orifice component 5 comprises two orifice units 10 and 11 arranged in series to one another and each orifice unit comprises an orifice plate 12 comprising at least one orifice 13, an orifice chamber 14 located upstream from the orifice plate 12 and in liquid communication with the orifice plate 12; and wherein neighboring orifice plates are distinct from each other;

connecting one or more suitable liquid pumping devices to the first inlet 1A and to the second inlet 1B;

pumping a second liquid composition into the first inlet 1A, and, pumping a liquid fabric softener active composition into the second inlet 1B, wherein the operating pressure of the apparatus is from 2.5 bar to 50 bar, from 3.0 bar to 20 or from 3.5 bar to 10 bar the operating pressure being the pressure of the liquid as measured in the first inlet 1A near to inlet 1B. The operating pressure at the outlet of apparatus A needs to be high enough to prevent cavitation in the orifice;

allowing the liquid fabric softener active and the second liquid composition to pass through the apparatus A at a desired flow rate, wherein as they pass through the apparatus A, they are dispersed one into the other, herein, defined as a liquid fabric softener intermediate.

passing said liquid fabric softener intermediate from Apparatus A's outlet, to Apparatus B's (FIG. 3) inlet 16 to subject the liquid fabric softener intermediate to additional shear and/or turbulence for a period of time within Apparatus B.

circulating said liquid fabric softener intermediate within apparatus B with a circulation Loop pump 17 at a Circulation Loop 18 Flow Rate equal to or greater than said inlet liquid fabric softener intermediate flow rate in said Circulation Loop System. A tank, with or without a recirculation loop, or a long conduit may also be employed to deliver the desired shear and/or turbulence for the desired time.

adding by means of a pump 19, piping and in-line fluid injector 20, an adjunct fluid, in one aspect, but not limited to a dilute salt solution, into Apparatus B to mix with the liquid fabric softener intermediate.

allowing the liquid fabric softener composition with the desired microstructure to exit Apparatus B 21 at a rate equal to the inlet flow rate into Apparatus B.

passing said liquid fabric softener composition exiting Apparatus B outlet through a heat exchanger to be cooled to ambient temperature, if necessary.

discharging the resultant liquid fabric softener composition produced out of the outlet of the process.

The process comprises introducing, in the form of separate streams, the fabric softener active in a liquid form and a second liquid composition comprising other components of a fabric softener composition into the pre-mixing chamber 2 of Apparatus A so that the liquids pass through the orifice component 5. The fabric softener active in a liquid form and the second liquid composition pass through the orifice component 5 under pressure. The fabric softener active in liquid form and the second liquid composition can be at the same or different operating pressures. The orifice component 5 is configured, either alone, or in combination with some other component, to mix the liquid fabric softener active and the second liquid composition and/or produce shear and/or turbulence in each liquid, or the mixture of the liquids.

The liquids can be supplied to the apparatus A and B in any suitable manner including, but not limited to through the use of pumps and motors powering the same. The pumps can supply the liquids to the apparatus A under the desired operating pressure. In one embodiment, an '8 frame block-style manifold' is used with a 781 type Plunger pump available from CAT pumps (1681 94th Lane NE, Minneapolis, Minn. 55449).

The operating pressure of conventional shear and/or turbulence apparatuses is typically between 2 bar and 490 bar. The operating pressure is the pressure of the liquid in the inlet 1A near inlet 1B. The operating pressure is provided by the pumps.

The operating pressure of Apparatus A is measured using a Cerphant T PTP35 pressure switch with a RVS membrane, manufactured by Endress Hauser (Endress+Hauser Instruments, International AG, Kaegenstrasse 2, CH-4153, Reinach). The switch is connected with the inlet 1A near inlet 1B using a conventional thread connection (male thread in the pre-mix chamber housing, female thread on the Cerphant T PTP35 pressure switch).

The operating pressure of Apparatus A may be lower than conventional shear and/or turbulence processes, yet the same degree of liquid mixing is achievable as seen with processes using conventional apparatuses. Also, at the same operating pressures, the process of the present invention results in better mixing than is seen with conventional shear and/or turbulence processes.

As the fabric softener active and the second liquid composition flow through the Apparatus A, they pass through the orifices 13 and 15 of the orifice component 5. As they do, they exit the orifice 13 and/or 15 in the form of a jet. This jet produces shear and/or turbulence in the fabric softener active and the second liquid composition, thus dispersing them one in the other to form a uniform mixture.

In conventional shear and/or turbulence processes, the fact that the liquids are forced through the orifice 13 and/or 15 under high pressure causes them to mix. This same degree of mixing is achievable at lower pressures when the liquids are forced through a series of orifices, rather than one at a high pressure. Also, at equivalent pressures, the process of the present invention results in better liquid mixing than shear and/or turbulence processes, due to the fact that the liquids are now forced through a series of orifices.

A given volume of liquid can have any suitable residence time and/or residence time distribution within the apparatus A. Some suitable residence times include, but are not limited to from 1 microsecond to 1 second, or more. The liquid(s) can flow at any suitable flow rate through the apparatus A. Suitable flow rates range from 1 to 1 500 L/min, or more, or any narrower range of flow rates falling within such range including, but not limited to from 5 to 1 000 L/min.

For Apparatus B Circulating Loop System example, one may find it convenient to characterize the circulation flow by a Circulation Loop Flow Rate Ratio which is equal to the Circulation Flow Rate divided by the Inlet Flow Rate. Said Circulation Loop Flow Rate Ratio for producing the desired fabric softener composition microstructure can be from 1 to 100, from 1 to 50, and even from 1 to 20. The fluid flow in the circulation loop imparts shear and turbulence to the liquid fabric softener to transform the liquid fabric softener intermediate into a desired dispersion microstructure.

The duration of time said liquid fabric softener intermediate spends in said Apparatus B may be quantified by a Residence Time equal to the total volume of said Circulation Loop System divided by said fabric softener intermediate inlet flow rate. Said Circulation Loop Residence Time for producing desirable liquid fabric softener composition microstructures may be from 0.1 seconds to 10 minutes, from 1 second to 1 minute, or from 2 seconds to 30 seconds. It is desirable to minimize the residence time distribution.

Shear and/or turbulence imparted to said liquid fabric softener intermediate may be quantified by estimating the total kinetic energy per unit fluid volume. The kinetic energy per unit volume imparted in the Circulation Loop System to the fabric softener intermediate in Apparatus B may be from 10 to 1 000 000 $g \cdot cm^{-1} \cdot s^{-2}$, from 50 to 500 000 $g \cdot cm^{-1} \cdot s^{-2}$, or from 100 to 100 000 $g \cdot cm^{-1} \cdot s^{-2}$. The liquid(s) flowing through Apparatus B can flow at any suitable flow rate. Suitable inlet and outlet flow rates range from 1 to 1 500 L/min, or more, or any narrower range of flow rates falling within such range including, but not limited to from 5 to 1 000 L/min. Suitable Circulation Flow Rates range from 1 L/min to 20 000 L/min or more, or any narrower range of flow rates falling within such range including but not limited to from 5 to 10 000 L/min. Apparatus A is ideally operated at the same time as Apparatus B to create a continuous process. The liquid fabric softener intermediate created in Apparatus A may also be stored in a suitable vessel and processed through apparatus B at a later time.

EXAMPLES

A fabric softener composition was prepared by first preparing a dispersion of the quaternary ammonium ester softener active ("FSA") using apparatus A and B in a continuous fluid making process with 3 orifices. Coconut oil and isopropanol were added to the hot FSA at 81° C. to form an FSA premix. Heated FSA premix at 81° C. and heated deionized water at 65° C. containing adjunct materials NaHEDP chelant, HCl, formic acid, and the preservative were fed using positive displacement pumps, through Apparatus A, through apparatus B, a circulation loop fitted with a centrifugal pump. $CaCl_2$ was added as an aqueous dilution through the in-line fluid injector of Apparatus B. The liquid fabric softener composition was immediately cooled to 25° C. with a plate heat exchanger. The total flow rate was 3.1 kg/min; pressure at Apparatus A Inlet 5 bar; pressure at Apparatus A Outlet 2.5 bar; Apparatus B Circulation Loop Flow rate Ratio 8.4; Apparatus B Kinetic Energy 18000 $g \cdot cm^{-1} \cdot s^{-2}$; Apparatus B Residence Time 14 s; Apparatus B Outlet pressure 3 bar.

The fabric softener composition was finished by adding encapsulated perfume using an IKA Ultra Turrax (dispersing element 8G) operated at 10 000 rpm for 1 minute. When present, the cationic polymer or cellulose fibers were added to the fabric softener with an IKA Ultra Turrax (dispersing element 8G) for 10 min at 20 000 rpm.

Fabrics were treated with compositions 1 through 4 according to the method to treat fabrics with fabric softener composition (see METHODS). The headspace above the dry fabrics was measured by GCMS (see Methods) and the headspace concentration above treated cotton fabrics was compared to that above treated polyester fabrics. Because of the absence of dispersed perfume in compositions 1 through 4, the headspace concentration can be linked to the deposition and release of encapsulated benefit agent.

TABLE 1

Liquid fabric softener compositions examples 1 through 4. The example marked with an asterisk (*) are comparative examples.

| | Ex. 1* | Ex. 2* | Ex. 3* | Ex. 4 |
|---|---|---|---|---|
| | | | Weight % | |
| Deionized water | To balance | To balance | To balance | To balance |
| NaHEDP | 0.007 | 0.007 | 0.007 | 0.007 |
| Formic acid | 0.045 | 0.045 | 0.045 | 0.045 |
| HCl | 0.001 | 0.001 | 0.001 | 0.001 |
| Preservative[a] | 0.023 | 0.023 | 0.023 | 0.023 |

TABLE 1-continued

Liquid fabric softener compositions examples 1 through 4. The example marked with an asterisk (*) are comparative examples.

| | Ex. 1* | Ex. 2* | Ex. 3* | Ex. 4 |
|---|---|---|---|---|
| | | | Weight % | |
| FSA[b] | 9.19 | 9.19 | 9.19 | 9.19 |
| Antifoam[c] | 0.101 | 0.101 | 0.101 | 0.101 |
| Coconut oil | 0.31 | 0.31 | 0.31 | 0.31 |
| Isopropanol | 0.94 | 0.94 | 0.94 | 0.94 |
| $CaCl_2$ | 0.008 | 0.008 | 0.008 | 0.008 |
| Encapsulated perfume[d] | 0.4 | — | 0.4 | — |
| Encapsulated perfume[e] | — | 0.4 | — | 0.4 |
| Cationic polymer[f] | 0.3% | 0.3% | — | — |
| Cellulose fiber deposition aid[g] | — | — | 0.3% | 0.3% |
| Headspace ratio[h] | 1.66 | 2.70 | 0.88 | 1.00 |

[a]Proxel GXL, 20% aqueous dipropylene glycol solution of 1,2-benzisothiazolin-3-one, supplied by Lonza. This material is part of the dispersion that is made and is not added at another point in the process.

[b]DEEDMAC: diethyl-ester-dimethyl-ammonium-chloride

[c]MP10 ®, supplied by Dow Corning, 8% activity

[d]Suitable melamine formaldehyde based perfume capsules can be purchased from Encapsys (825 East Wisconsin Ave, Appleton, WI 54911), and are made as follows: 25 grams of butyl acrylate-acrylic acid copolymer emulsifier (Colloid C351, 25% solids, pka 4.5-4.7, (Kemira Chemicals, Inc. Kennesaw, Georgia U.S.A.)) is dissolved and mixed in 200 grams deionized water. The pH of the solution is adjusted to pH of 4.0 with sodium hydroxide solution. 8 grams of partially methylated methylol melamine resin (Cymel 385, 80% solids, (Cytec Industries West Paterson, New Jersey, U.S.A.)) is added to the emulsifier solution. 200 grams of perfume oil is added to the previous mixture under mechanical agitation and the temperature is raised to 50° C. After mixing at higher speed until a stable emulsion is obtained, the second solution and 4 grams of sodium sulfate salt are added to the emulsion. This second solution contains 7 grams of butyl acrylate-acrylic acid copolymer emulsifier (Colloid C121, 25% solids, Kemira), 120 grams of distilled water, sodium hydroxide solution to adjust pH to 4.8, 25 grams of partially methylated methylol melamine resin (Cymel 385, 80% solids, Cytec). This mixture is heated to 85° C. and maintained overnight with continuous stirring to complete the encapsulation process. 23 grams of acetoacetoamide (Sigma-Aldrich, Saint Louis, Mo USA) are added. A volume-mean particle size of 18 microns is obtained. Then perfume capsules are coated with a polyvinylformamide deposition aid as follows: 0.6 grams of a cationic modified copolymer of polyvinylamine and N-vinyl formamide (BASF Corp) are added and mixed overnight.

[e]Polyacrylate based capsules encapsulating perfume.

Suitable perfume capsules can be purchased from Encapsys, (825 East Wisconsin Ave, Appleton, Wis. 54911), and are made as follows: a first oil phase, consisting of 37.5 g perfume, 0.2 g tert-butylamino ethyl methoacrylate, and 0.2 g beta hydroxyethyl acrylate is mixed for about 1 hour before the addition of 18 g CN975 (Sartomer, Exter, Pa.). The solution is allowed to mix until needed later in the process.

A second oil phase consisting of 65 g of the perfume oil, 84 g isopropyl myristate, 1 g 2,2'-azobis(2-methylbutyronitrile), and 0.8 g 4,4'-azobis[4-cyanovaleric acid] is added to a jacketed steel reactor. The reactor is held at 35° C. and the oil solution in mixed at 500 rpm's with a 2" flat blade mixer. A nitrogen blanket is applied to the reactor at a rate of 300 cc/min. The solution is heated to 70° C. in 45 minutes and held at 70° C. for 45 minutes, before cooling to 50° C. in 75 minutes. At 50° C., the first oil phase is added and the combined oils are mixed for another 10 minutes at 50° C.

A water phase, containing 85 g Celvol 540 PVA (Sekisui Specialty Chemicals, Dallas, Tex.) at 5% solids, 268 g water, 1.2 g 4,4'-azobis[4-cyanovaleric acid], and 1.1 g 21.5% NaOH, is prepared and mixed until the 4,4'-AZOBIS[4-CYANOVALERIC ACID] dissolves. The water phase pH for this batch was 4.90.

Once the oil phase temperature has decreased to 50° C., mixing is stopped and the water phase is added to the mixed oils. High shear agitation is applied to produce an emulsion with the desired size characteristics (1900 rpm's for 60 minutes.)

The temperature was increased to 75° C. in 30 minutes, held at 75° C. for 4 hours, increased to 95° C. in 30 minutes, and held at 95° C. for 6 hours. The batch was allowed to cool to room temperature.

[f]Rheovis® CDE, cationic polymeric acrylate thickener supplied by BASF

[g]Exilva®, microfibrous cellulose, expressed as 100% dry matter, supplied by Borregaard as an aqueous 10% microfibrous cellulose dispersion.

[h]Ratio between headspace above dried treated cotton fabrics versus dried treated polyester fabrics as determined by GCMS.

Consumers desire that encapsulated benefit agents are released during use of treated fabrics, regardless of the type of fabric material. However, we observed in comparative example 1 through 3 that the release of benefit agents from fabrics treated with a liquid fabric softener varied, and hence also the experienced benefit was expected to vary with varying fabric material upon use.

Comparative example 2 as compared to comparative example 1 showed that there is an effect of the capsule shell. Shells comprising polyacrylate polymers (ex. 2) further magnified the difference in headspace concentration above treated cotton versus polyester fabrics, as compared shells comprising melamine formaldehyde (ex. 1).

Comparative example 3 as compared to comparative example 1 showed that there is also an effect of the type of deposition aid. Cellulose fibers resulted in an inversion on the headspace ratio as compared to the effect of the cationic polymeric deposition aid. This suggests that cellulose fibers mainly had a positive effect on the deposition and release of the benefit agent on polyester fabrics while the cationic polymer Rheovis CDE mainly had a positive effect on the deposition and release on cotton fabrics.

Example 4, according to the present invention, shows that we have surprisingly found that liquid fabric softener compositions comprising polyacrylate based capsules encapsulating benefit agents and cellulose fibers led to equal headspace concentration above treated cotton fabrics and polyester fabrics.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition of the same term in a document incorporated by reference, the meaning of definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid fabric softener composition, comprising:

a) from about 4.5% to about 15%, based on total composition weight, of a quaternary ammonium ester softening active, wherein said quaternary ammonium ester softening active is diethyl-ester-dimethyl-ammonium-chloride;

b) from about 0.1% to about 0.75%, based on total composition weight, of cellulose fibers, wherein the cellulose fibers are microfibrous cellulose derived from bacterial or botanical origin;

c) from about 0.05% to about 10% by weight benefit agent capsules comprising a core and a shell encapsulating said core, wherein said shell comprises polyacrylate polymer, wherein said shell comprises from about 50% to about 100% of said polyacrylate polymer, wherein said shell comprises a polymer derived from a material that comprises one or more multifunctional acrylate moieties, wherein the core comprises a benefit agent, wherein the benefit agent comprises perfume; and d) from about 70% to about 95%, based on total composition weight, of water.

2. The liquid fabric softener composition according to claim 1, wherein the cellulose fibers have an average diameter from about 10 nm to about 350 nm.

3. The liquid fabric softener composition according to claim 1, wherein said shell comprises a polyacrylate that comprises a moiety selected from the group consisting of an amine acrylate moiety, methacrylate moiety, a carboxylic acid acrylate moiety, carboxylic acid methacrylate moiety and combinations thereof.

4. The liquid fabric softener composition according to claim 1, wherein said shell comprises a polymer derived from a material that comprises one or more multifunctional acrylate and/or methacrylate moieties to material that comprises one or more methacrylate moieties is about 999:1 to about 6:4, said multifunctional acrylate moiety being selected from group consisting of tri-functional acrylate, tetra-functional acrylate, penta-functional acrylate, hexa-functional acrylate, hepta-functional acrylate and mixtures thereof; and optionally a polyacrylate that comprises a moiety selected from the group consisting of an amine acrylate moiety, methacrylate moiety, a carboxylic acid acrylate moiety, carboxylic acid methacrylate moiety and combinations thereof.

5. The liquid fabric softener composition according to claim 1, wherein the composition further comprises dispersed perfume at a level of from about 0.1% to about 10%, by weight of the composition.

6. The liquid fabric softener composition according to claim 1, wherein the liquid fabric softener composition has a viscosity from about 20 mPa·s and about 1000 mPa·s, as measured with a rotational viscometer, spindle 2 for viscosities between about 20 mPa·s and about 400 mPa·s, spindle 3 for viscosities between about 401 mPa·s and about 1000 mPa·s, at about 60 rpm, at about 21° C.

7. The liquid fabric softener composition according to claim 1, wherein the liquid fabric softener composition has a dynamic yield stress at about 20° C. from about 0.001 Pa to about 1.0 Pa.

8. A method of treating a fabric, said method comprising a) optionally washing, rinsing and/or drying said fabric;

b) contacting said fabric with a liquid fabric softener composition according to claim 1; and c) optionally drying said fabric wherein said drying steps comprise active drying and/or passive drying.

9. The liquid fabric softener composition according to claim 1, wherein said polyacrylate comprises a polyacrylate cross linked polymer.

10. The liquid fabric softener composition according to claim 1, wherein said one or more multifunctional acrylate moieties is selected from the group consisting of tri-functional acrylate, tetra-functional acrylate, penta-functional acrylate, hexa-functional acrylate, hepta-functional acrylate, and mixtures thereof.

* * * * *